United States Patent [19]

Underwood

[11] 3,972,416

[45] Aug. 3, 1976

[54] SAFETY MATCHBOOK WITH LATCHING MEANS

[76] Inventor: Ralph E. Underwood, 11820 Washington, Kansas City, Mo. 64114

[22] Filed: Aug. 4, 1975

[21] Appl. No.: 601,591

[52] U.S. Cl. ..... 206/106; 206/1.5; 206/459

[51] Int. Cl.[2] ..... A24F 27/12

[58] Field of Search ..... 206/1.5, 96–120, 206/459, 472, 474; 220/339

[56] References Cited

UNITED STATES PATENTS

| | | | |
|---|---|---|---|
| 1,153,875 | 9/1915 | Fuller | 206/116 |
| 1,344,746 | 6/1920 | Wemmell | 206/118 |
| 1,588,448 | 6/1926 | Colgate | 206/118 |
| 1,657,789 | 1/1928 | Colgate | 206/118 |
| 2,105,425 | 1/1938 | Lee | 206/107 |
| 2,121,136 | 6/1938 | Wallace | 206/114 |
| 2,206,606 | 7/1940 | Holter | 206/118 |
| 2,311,794 | 2/1943 | Warner | 206/104 X |
| 2,619,226 | 11/1952 | Adams | 206/1.5 X |
| 3,033,361 | 5/1962 | Will | 206/118 |
| 3,113,666 | 12/1963 | Will | 206/118 |

FOREIGN PATENTS OR APPLICATIONS

| | | | |
|---|---|---|---|
| 1,059,275 | 3/1954 | France | 206/107 |

*Primary Examiner*—William Price
*Assistant Examiner*—Stephen Marcus
*Attorney, Agent, or Firm*—Lowe, Kokjer, Kircher et al

[57] ABSTRACT

A safety matchbook is constructed with the usual front cover which tucks beneath a lower flap to close the matchbook. A ridge mounted on the underside of the flap is provided with a central opening. A projection mounted on the front cover at an off center location fits through the opening in order to interlock with the ridge and latch the matchbook in its closed position. To open the matchbook, the cover must be flexed laterally and simultaneously pushed downwardly to pass the projection by a stop member. The flap must then be raised in order to permit the projection to clear a ramp structure located within the ridge opening.

8 Claims, 6 Drawing Figures

SAFETY MATCHBOOK WITH LATCHING MEANS

BACKGROUND AND SUMMARY OF THE INVENTION

This invention relates generally to a matchbook which contains safety matches and deals more particularly with a matchbook of this type which is retained closed by an improved latching means.

Conventional cardboard matchbooks which contain safety matches are easily opened by small children, and the matches contained in the matchbook are thus easily accessible to the children. Accordingly, there is a need to provide a safety matchbook which prevents children from gaining access to the matches. It is the primary goal of the present invention to meet this need.

More specifically, an object of the invention is to provide, in a safety matchbook, an improved latching means which requires a series of movements that are sufficiently complex to prevent and/or discourage small children from opening the matchbook.

Another object of the invention is to provide a matchbook latching means of the character described that is inexpensive to construct and relatively simple for adults to open and close.

A further object of the invention is to provide a matchbook latching means of the character described which may be readily incorporated into existing conventional matchbooks without increasing their size.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like reference numerals are employed to indicate like parts in the various views.

Figure 1:
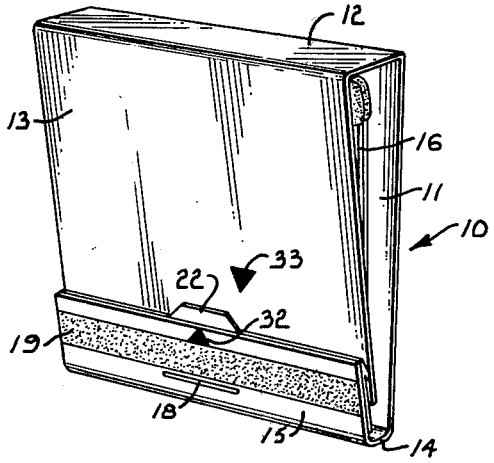
FIG. 1 is a perspective view of a matchbook constructed in accordance with a preferred embodiment of the invention shown in its closed position.

Referring now to the drawing in detail, and initially to FIG. 1, numeral 10 generally designates a matchbook which is of a conventional construction and configuration for the most part. A flat back section 11 of the matchbook has a forwardly turned upper end portion 12 which serves as a hinge for the front cover 13. A lower end portion 14 of the matchbook extends forwardly from the lower edge of back section 11. A relatively short flap 15 extends upwardly from the front edge of end portion 14 in the usual manner. The matchbook is constructed of flexible material which is preferably non-flammable. It is additionally contemplated that back section 11 and front cover 13 may be provided with lateral edges (not as shown) that overlap when the matchbook is closed.

The paper or cardboard safety matches 16 extend from paper strips 17 (FIG. 3) which are secured between back section 11 and flap 15 by a staple 18. The matches 16 are thus located within the matchbook between back section 11 and front cover 13 when the matchbook is closed. The matches may be torn away from strips 17 and ignited by striking their tips against an abrasive strip 19 which is secured to the exterior of flap 15 by any suitable means.

The present invention provides a latching means which retains the lower edge of front cover 13 beneath flap 15 in order to prevent small children from opening the matchbook and obtaining access to the matches. With reference to FIGS. 3–6, a flat mounting strip 20 is secured against the underside of flap 15 by glue, staples, or any other appropriate means. A downwardly projecting ridge 21 is formed integrally on the strip 20 at a location near the edge of flap 15. Ridge 21 is preferably constructed of nylon or a rigid plastic material. A tab 22 is formed centrally on strip 20 in order to project beyond the edge of flap 15 at an accessible position when the matchbook is closed. The edge of strip 20 generally coincides with the edge of flap 15.

Figure 5:
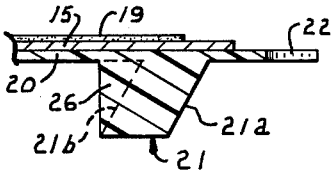
FIG. 5 is a fragmentary cross-sectional view taken generally along line 5—5 of FIG. 4 in the direction of the arrows.

Ridge 21 has generally parallel, flat sides which are designated by numerals **21*a* and 21*b* in FIG. 5. Side 21*a* is nearest tab 22 and extends from mounting strip 20 at an obtuse angle. The other side 21*b* extends from mounting strip 20 at an acute angle. The underside of ridge 21** is a flat surface.

Figure 4:
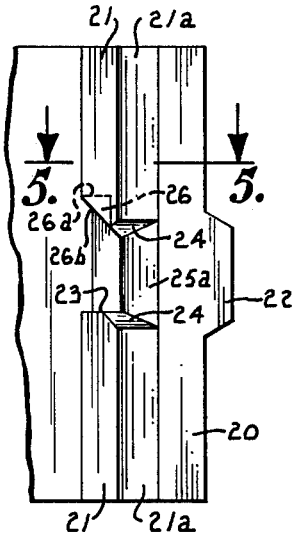
FIG. 4 is a fragmentary view on a still larger scale taken generally along line 4—4 of FIG. 3 in the direction of the arrows.
Figure 6:
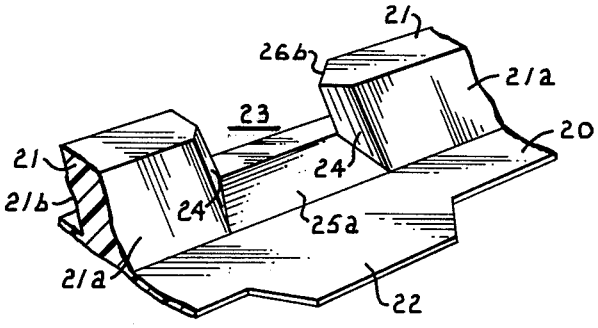
FIG. 6 is an enlarged fragmentary view in perspective illustrating the ridge and the opening thereof shown in FIG. 4.

Ridge 21 preferably extends substantially the entire width of flap 15. As best illustrated in FIGS. 4 and 6, an opening 23 is formed through the ridge at a central location thereon. Angled side surfaces 24 of opening 23 are beveled in a manner such that the lateral dimension of opening 23 gradually decreases toward the center from the end nearest tab 22. Accordingly, the entry to opening 23 is enlarged relative to the remainder thereof.

An inclined ramp structure 25 (FIG. 3) is formed integrally on mounting strip 20 at a location within opening 23. An inclined side **25*a* of the ramp extends downwardly and away from tab 22 at an inclined angle relative to strip 20 for approximately half the thickness of ridge 21. Side 25*a* is inclined at an even greater angle than side 21*a* of the ridge. The ramp has a flat underside 25*c* which is located below strip 20 a distance equal to approximately half the height of ridge 21. The side 25*b* of the ramp farthest from tab 22 is inclined at an angle equal to that of side 21*b*** of the ridge.

With reference to FIGS. 4 and 5, a small generally triangular block 26 is formed integrally on ridge 21 at a location adjacent to one side of opening 23 (the right side of the opening as viewed in FIG. 1). Block 26 is located against side **21*b* of the ridge and has a flat side 26*a* which extends between mounting strip 20 and the edge of side 21*b*. Side 26*a* is oriented perpendicular to ridge 21 and increases the difficulty of disengaging the latching means, as will be described in more detail. Another flat side 26*b* of the block is located adjacent to opening 23** and is oriented at an angle to provide a beveled surface on the exit of the opening which facilitates engagement of the latching means, as will also be described in more detail.

Figure 2:
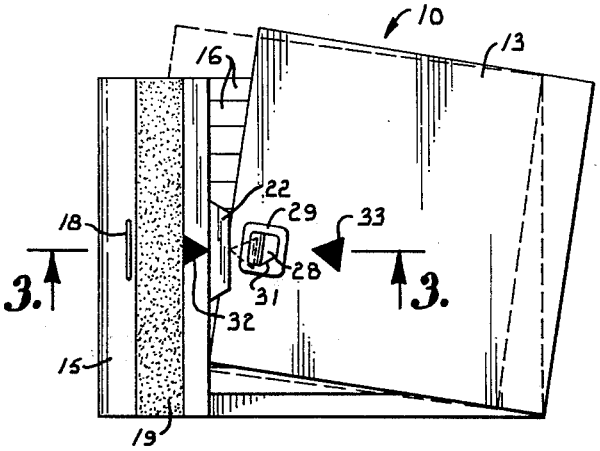
FIG. 2 is a front elevational view illustrating the matchbook shown in FIG. 1 opened, but positioned to permit it to be closed, the broken lines indicating partial closing of the matchbook.
Figure 3:
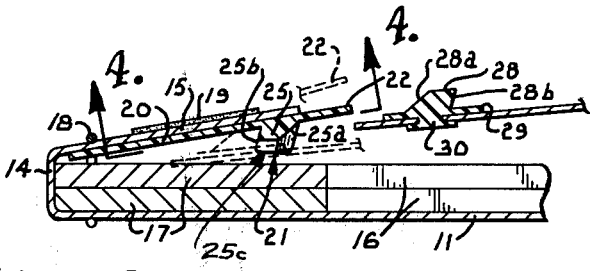
FIG. 3 is a fragmentary cross-sectional view on an enlarged scale taken generally along line 3—3 of FIG. 2 in the direction of the arrows, the broken lines indicating lifting of the flap and insertion of the front cover beneath the flap to close the matchbook.

Referring now to FIGS. 2 and 3, an upstanding projection member 28 extends outwardly from a thin, flat mounting strip 29 which is secured to front cover 13 at a location near the lower edge thereof. A rivet 30 (FIG. 3) preferably secures strip 29 to the front cover, although it is contemplated that member 28 may be mounted in any other suitable manner. Like ridge 21, member 28 is preferably constructed of nylon or a rigid plastic substance. Member 28 is offset to the right side of center on cover 13, as can best be seen in FIG. 2. With reference to FIG. 2, member 3, has an inclined side 28*a* which is located nearest the edge of cover 13 and which is angled to contemplate the angle of ramp side 25*a*. The projection member has a flat top surface, while the side 28*b* farthest from the edge of cover 13 is inclined relative to strip 29 at an angle that matches the angle of side 21*b* of the ridge. One corner of member 28 is cut away at an angle to provide a beveled surface 31 (FIG. 2).

Flap 15 is imprinted with a small arrow 32, the tip of which points to opening 23. Another arrow 33 is imprinted on front cover 13 at a location to indicate the center of member 28.

In use, the matchbook may be closed and latched in its closed position to prevent it from being opened by small children. To close the matchbook, it is necessary to flex front cover 13 laterally to the position shown in FIG. 2, wherein arrows 32 and 33 are aligned. Projection member 28 is then aligned with opening 23 and may be passed into the opening. It is noted that the beveled surfaces 24 provide an enlarged entry to the opening which facilitates the insertion of member 28 therein. As front cover 13 is slid beneath flap 15, the inclined side 28*a* of member 28 is moved against the inclined ramp side 25*a*, and the resulting camming action forces member 28 away from flap 15 such that it is able to clear the ramp structure and pass through opening 23. After member 28 has cleared ramp side 25*a*, it slides along the angled side 26*b* of block 26 until it has completely cleared the block. Cover 13 may then be unflexed or moved to its normal position shown in FIG. 1. This results in member 28 becoming interlocked with ridge 21, and the correspondingly angled sides 28*b* and 21*b* thereafter remain against one another as shown in the broken line view of FIG. 3, to retain the cover in its closed position.

Front cover 13 is naturally drawn away from back section 11 and also away from the lower portion 14, primarily due to the hinge construction of the upper end portion 12. Accordingly, member 28 is firmly retained in interlocking engagement against ridge 21, and small children will not be able to gain access to the matches within the closed matchbook. It is contemplated that member 28 and ridge 21 will be of sufficient height to prevent them from being directly disengaged unless flap 15 is pulled upwardly far enough to severely bend or disform it, and this requires a force beyond the capability of small children.

To open the matchbook, front cover 13 must be flexed to the left (as viewed in FIG. 1) until arrows 32 and 33 are in alignment. However, unless cover 13 is also pushed downwardly or toward end portion 14, member 28 will engage the flat side 26*a* of block 26, which will prevent it from moving into alignment with opening 23. Cover 13 must therefore be flexed to the left and also pushed or slid downwardly at the same time in order to bring member 28 into alignment with opening 23. Even after arrows 32 and 33 have been aligned, cover 13 can not be freely withdrawn from beneath flap 15 because side 28*b* will engage side 25*b* of the ramp. Therefore, tab 22 must be pulled outwardly to the position shown in broken lines in FIG. 3 in order to permit member 28 to clear side 25*b* and enter opening 23. Member 28 may then be freely passed through the opening to withdraw cover 13 from flap 15 and open the matchbook.

It is thus apparent that cover 13 must be flexed laterally and simultaneously pushed downwardly until arrows 32 and 33 are aligned, and tab 22 must then be lifted outwardly before the cover can be withdrawn from flap 15. Small children will not be able to open the matchbook by manipulating it through this rather complicated series of movements, although adults will encounter no serious difficulty in opening or closing the matchbook.

From the foregoing, it will be seen that this invention is one well adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. In a matchbook having first and second flap members adapted to overlap one another to close the matchbook, the combination therewith of:

a ridge connected to said first flap member to project therefrom;

means defining an opening in said ridge; and a projection connected to said second flap member and adapted to engagingly interlock with said ridge to latch said first and second flap members in overlapping relation, said projection being laterally offset from said opening but alignable therewith upon lateral flexing of one of said flap members, said projection being of a size to pass through said opening into and out of interlocking engagement with said ridge.

2. The combination of claim 1, including a stop member located in proximity to said opening at a position to impede alignment of said projection with said opening when said projection and ridge are interlocked, said first and second flap members being slidable relative to one another to permit movement of said projection past said stop member and into alignment with said opening.

3. The combination of claim 2, wherein said stop member includes a surface angling along one side of said opening to facilitate the movement of said projection past said stop member and into interlocking engagement with said ridge.

4. The combination of claim 1, including an obstruction located within said opening to impede the passage of said projection therethrough in a direction disengaging said projection from said ridge, said first and second flap members being movable away from one another to permit said projection to clear said obstruction and pass through said opening.

5. The combination of claim 4, wherein said obstruction includes an inclined surface angled to facilitate movement of said projection through said opening in a direction to interlock with said ridge.

6. The combination of claim 1, including means defining an enlarged entry to said opening to facilitate the entry of said projection into said opening in a direction to interlock with said ridge.

7. The combination of claim 1, including means on said first and second flap members for indicating the locations of said opening and projection, said indicating means being visible when said flap members are latched in overlapping relation.

8. The combination of claim 1, wherein said ridge and projection include inclined surfaces angled and shaped in conformity with one another for mating engagement to retain said ridge and projection interlocked.

* * * * *